US005146829A

United States Patent [19]

Wadzinski

[11] Patent Number: 5,146,829

[45] Date of Patent: Sep. 15, 1992

[54] STRAIGHT CUT COATER UNWIND KNIFE

[75] Inventor: Michael J. Wadzinski, Appleton, Wis.

[73] Assignee: Appleton Papers Inc., Appleton, Wis.

[21] Appl. No.: 658,819

[22] Filed: Feb. 22, 1991

[51] Int. Cl.[5] ..... B26D 1/09

[52] U.S. Cl. ..... 83/620; 83/636; 83/650; 83/697; 242/56 R

[58] Field of Search ..... 83/650, 426, 429, 437, 83/697, 614, 620, 636, 734; 242/56 R

[56] References Cited

U.S. PATENT DOCUMENTS

| | | | |
|---|---|---|---|
| 1,357,727 | 11/1920 | Roach | 83/620 X |
| 2,393,845 | 1/1946 | Wagner et al. | 83/169 |
| 2,772,732 | 12/1956 | Kerwin et al. | 83/424 |
| 2,895,552 | 7/1959 | Pomper et al. | 83/92 |
| 3,593,611 | 7/1971 | Sagehorn | 83/620 X |
| 3,677,122 | 7/1972 | Rautine | 83/506 |
| 3,762,250 | 10/1973 | Huskey | 83/27 |
| 3,807,261 | 4/1974 | Cavreur | 83/614 X |
| 3,890,763 | 6/1975 | Ullman | 83/620 X |
| 4,014,233 | 3/1977 | Wölfinger et al. | 83/156 |
| 4,334,447 | 6/1982 | Martin et al. | 83/620 X |
| 4,604,929 | 8/1986 | Vallance | 83/636 X |
| 4,688,455 | 8/1987 | Takehara | 83/175 |
| 4,757,732 | 7/1988 | Arima | 83/425.2 |
| 5,014,924 | 5/1991 | Nowisch et al. | 242/56 R |

*Primary Examiner*—Frank T. Yost
*Assistant Examiner*—Raymond D. Woods
*Attorney, Agent, or Firm*—Birch, Stewart, Kolasch & Birch

[57] ABSTRACT

A web severing device for providing a smooth severed edge on a moving web. The device includes a support member and a plurality of independent blade sections mounted on the support member at substantially a 45° angle with respect thereto. In one embodiment, a forward portion of each of the blade sections is angled toward a center of the support member whereas in a second embodiment, the blades are alternately angled toward and away from the center of the support member. In all embodiments, the support member is selectively released toward the web, and the plurality of blade sections simultaneously engage with the web to sever the same.

12 Claims, 7 Drawing Sheets

STRAIGHT CUT COATER UNWIND KNIFE

BACKGROUND OF THE INVENTION

1. Field of the Invention

The present invention relates to a flying splice knife for cutting a moving web. More specifically, the present invention relates to a flying spice knife for cutting a moving web in which a plurality of individual blade sections are mounted at predetermined angles with respect to a support member whereby the plurality of blade sections are simultaneously engageable with the moving web.

2. Description of Related Art

A "flying splice" of an expiring wound roll of flexible web material to another wound roll of web material allows for continuous operation of web handling equipment without stopping or slowing a machine to join web material together from two different rolls. The success rate of making flying splices that do not fail or clog machine parts is critical to the efficiency of web-handling equipment. For this reason, equipment is required to sever a web and form a splice. The equipment is constantly monitored and worked on to minimize operating costs and improve efficiency.

A typical mechanism for making overlapped flying splices is shown in FIGS. 9–15. In FIG. 9, an expiring wound roll 71 of web material 72 is shown being unwound by rotation on spindle A past an idler roller 74 leading to a processing machine (not shown). As the material or web from expiring roll 71 is exhausted, a turrent 70 interchanges a new roll 76 rotating on spindle B with the expiring roll 71 by rotating the turrent 70 around a turrent axis 78 in a clockwise direction. Before the new roll 76 is interchanged with the expiring roll 71, a two-sided adhesive tape 80 is placed along the leading edge 82 of an unspliced web of the new roll 76. A rubber paster roller 84 is used to compress the two webs together and is shown positioned in a retracted position to allow the turrent 70 to rotate.

FIG. 10 shows the turrent 70 rotated 180° in order to position the expiring web 72 under one of two flying splice knives 86, 87. Each knife 86, 87 is on opposite sides of turrent 70 and positioned between two rotatable support rollers 88. The knife 86 is shown in a "ready to fire" position. After the turrent 70 is repositioned through the above-mentioned 180° rotation, the new roll 76 is accelerated to rotate at the same outer surface speed as the web 72 while the paster roller 84 is moved to the "ready to fire" position.

FIG. 11 shows the splicing mechanism in action. When the expiring roll 71 reaches a minimum diameter, the severing and splicing sequence is triggered, thereby firing the paster roller 84 against the new roll 76 which sticks the expiring web 72 to the new roll 76 as the two-sided adhesive 80 passes through a nip formed by the paster roll 84 pressed against the new roll 76. Almost simultaneously, the flying splice knife 86 is fired downward into the expiring web 72 by a high speed pneumatic or hydraulically actuated firing mechanism 90 at an angle perpendicular to a longitudinal axis of the web 72. The web 72 severs when the tension of the web 72 over the knife 86 becomes large enough to tear the web 72 in a crosswise direction. After an expired core located at the center of the expired roll 71 is removed and replaced with a fresh wound roll on spindle A, the severing and splicing cycle is ready to be repeated, this time using the remaining flying splice knife 87 after another 180° clockwise rotation of the turrent 70.

FIG. 12 shows a more detailed view of a conventional flying splice knife 92. The width of the knife blade can vary widely, but is typically 100 inches (254 cm) in length as shown at $l_1$, The knife 92 is oriented with its firing or z-axis 94 and its cross direction or y-axis 96 perpendicular to the web surface 98 and web travelling direction 100, respectively. A velocity of the web 98 typically ranges between 500 and 3000 feet per minute (fpm) (254 cm/sec to 1524 cm/sec). The velocity of the knife 92 typically ranges between 300 and 700 feet per minute (152.4 cm/sec to 355.6 cm/sec) depending upon the configuration of the actuator mechanism 90 and the size and type of hydraulic or pneumatic cylinders used to energize the actuator mechanism. Knife velocity is varied by changing the cylinder pressure Typically, knives have a 4 to 6 inch (10.16 cm to 15.24 cm) total firing distance and reach full speed after 2 to 3 inches (5.08 cm to 7.62 cm) of travel. These knives are generally equipped with triangular-shaped teeth 102 with sharpened bevel-cut edges. Tooth width and length range between $\frac{3}{8}$ inch and $\frac{3}{4}$ inch (0.9525 cm to 1.905 cm) shown at w1, and $l_2$, respectively.

FIG. 13 illustrates a typical web tear resulting from the conventional flying splice knife 92. The machine direction 104 and knife orientation 106 are labeled. Initial contact of knife teeth tips 103 with the web 98 results in generating machine direction tears 108. The length $l_3$ of these tears is typically 7 to 14 inches (17.78 cm to 35.56 cm) depending upon web speed, knife speed, web tension, substrate type, and number of teeth. In other words, the greater number of teeth, the longer the tears produced.

A second stage of the severing action is produced by the edges of the teeth when the pressure at the tip 103 of each tooth 102 becomes large enough to push the entire knife tooth 102 through the web. The time required for the knife tooth to pass through the web forms triangular shaped web tears 110. A spliced end 112 of the web 98 is sent through the processing machine. A non-spliced end 114 of the web 98 does not pass through the process and is that portion which would be found on the expiring roll 71.

FIG. 14 illustrates how the triangular tear 110 is generated by a conventional knife tooth 102, wherein the time tk required to complete one tooth cut is equal to the time required for the knife tooth 102 to travel a distance equal to dk, the tooth height. The time, tk, can be expressed as:

$$tk = dk/Vk \quad (1)$$

where Vk is equal to the knife tooth velocity. The distance dw the web travels in this amount of time is equal to the length of the tear. The distance, dw, can then be expressed in terms of Vk and Vw, the web velocity and dk, the tooth height, by equation 2.

$$dw = \frac{Vw\ dk}{Vk} \quad \text{Equation 2)}$$

Making the height dk of the tooth smaller by increasing the point angle to make the tooth blunter will act to shorten the tear triangle 110 but will also produce longer machine direction tears 108 by making it harder for the tooth 102 to penetrate through the web 98. Providing sharper, more pointed teeth will act to deflect the web 98 less which reduces the length of the machine direction tears 108 but increases the length of the tear triangle 110.

If a coating process performed on a spliced web at 118 as shown in FIG. 15 requires multiple cycles of wetting and drying on both sides of the web, the flying splices may fail. For example, ribbons 116 (shown as tear triangles 110 in FIG. 13) made by the tearing action of the knife allows excessive amounts of coating to accumulate between and under these ribbons 116 causing the ribbons to become weak and breakable away from the remaining web 98. The machine direction is again shown by arrow 104.

If this heavy coating area cannot be dried completely, the ribbon area will also become stuck to various machine parts such as a rod coater backing roll, resulting in the destruction of the splice and a web break.

Next, weakened splice ribbons 116 and other web fragments loosely attached to the web 98 as a result of web severance by the knife tend to easily tear off and clog drier nozzles or become caught in the coater rod causing coating application defects in the product.

Accordingly, a need in the art exists for a flying splice knife for severing a moving web which results in a relatively smooth finished edge which will in turn prevent numerous problems described above in connection with the conventional flying splice knives.

SUMMARY OF THE INVENTION

Accordingly, it is a primary object of the present invention to provide a flying splice knife for transversely severing a moving web which provides a substantially smooth splicing edge on the web subsequent to severing the same.

It is a further object of the present invention to provide a flying splice knife for severing a moving web which includes simultaneously actuated and specifically oriented individual blade members for accomplishing the smoothly severed edge described above.

The objects of the present invention are fulfilled by providing a flying splice knife for cutting a moving web which includes a support member positioned perpendicular to a direction of travel of the moving web, the support member is selectively movable toward and away from the web. A first plurality of blade sections are mounted at a predetermined angle with respect to the support member. A second plurality of blade sections are mounted at a predetermined angle with respect to the support member and mutually opposing the first plurality of blade sections. The first and second plurality of blade sections simultaneously engage with the traveling web in a direction substantially parallel to travel of the web for providing a substantially smooth splicing edge on the web.

BRIEF DESCRIPTION OF THE DRAWINGS

The present invention will become more fully understood from the detailed description given hereinbelow and the accompanying drawings which are given by way of illustration only, and wherein.

Figure 5A:
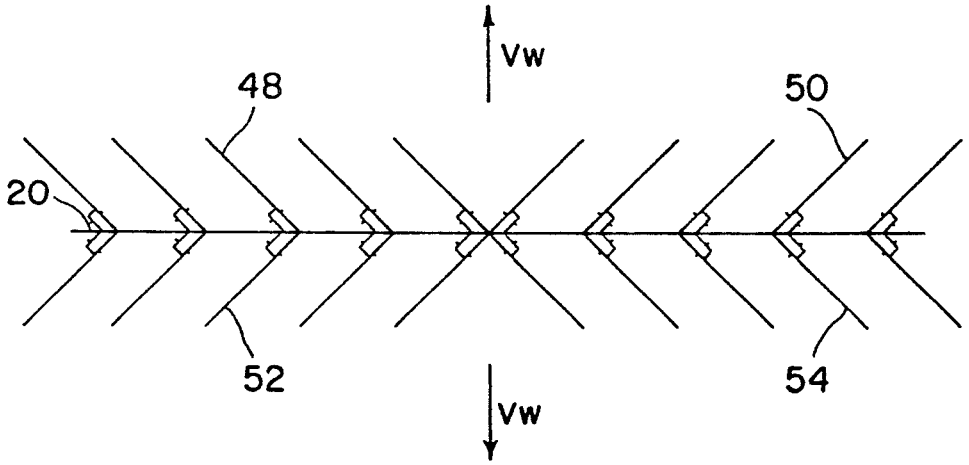
Figure 5B:
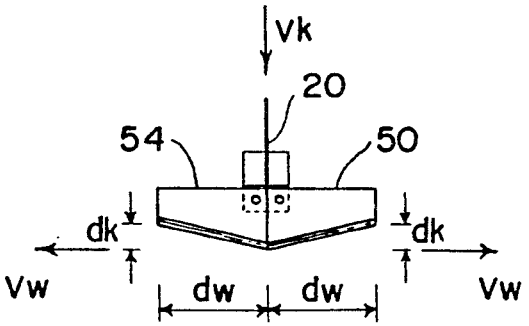
Figure 6:
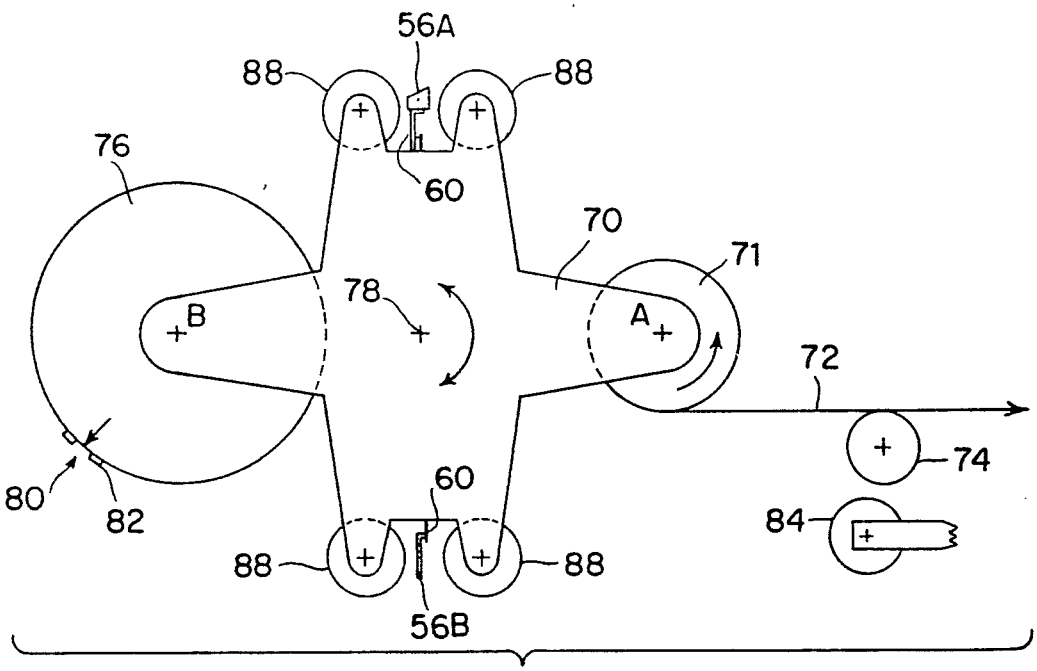
Figure 7:
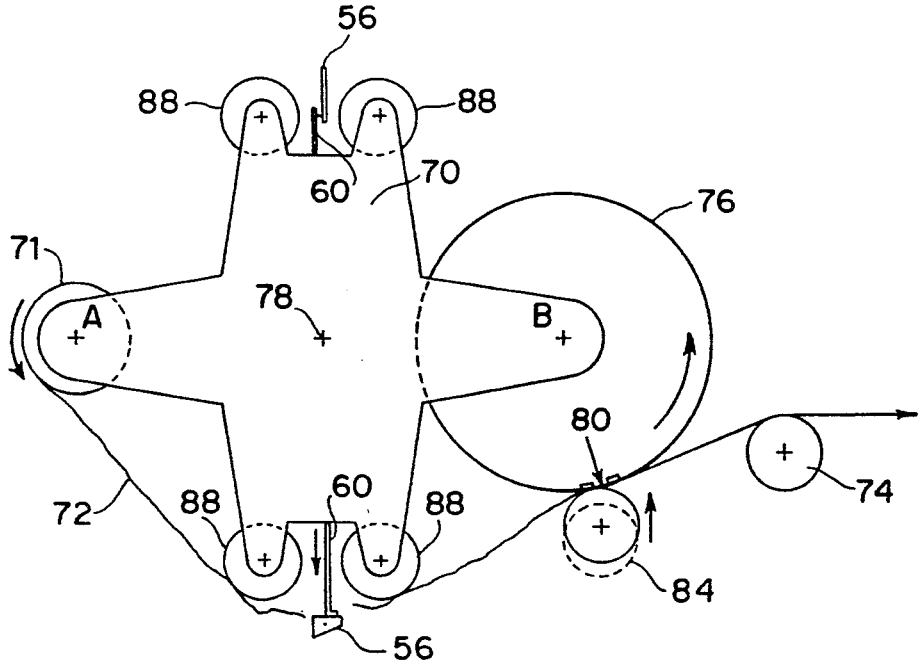
Figure 8:
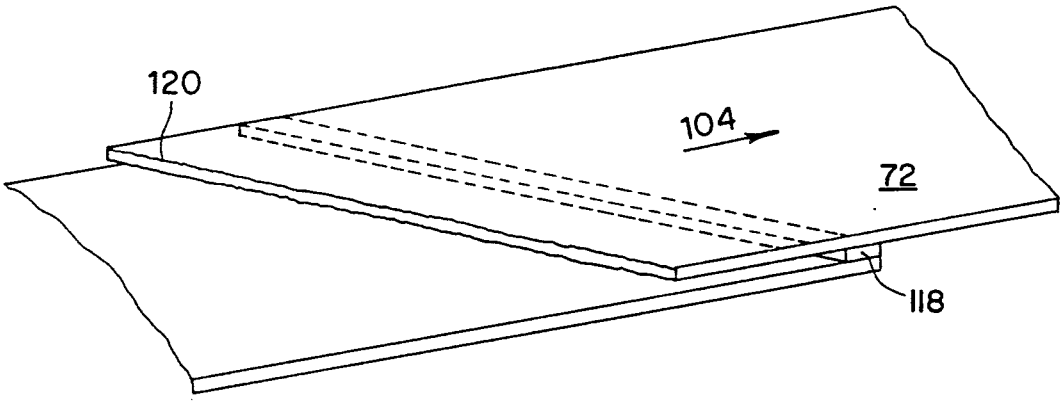
Figure 9:
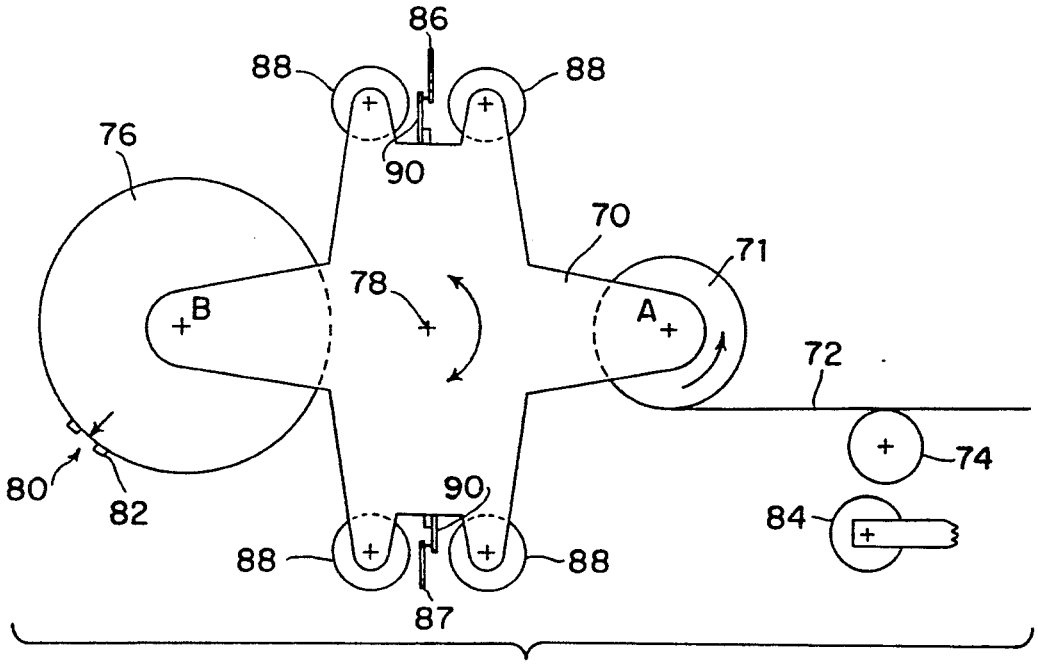
FIG. 9 CONVENTIONAL ART
Figure 10:
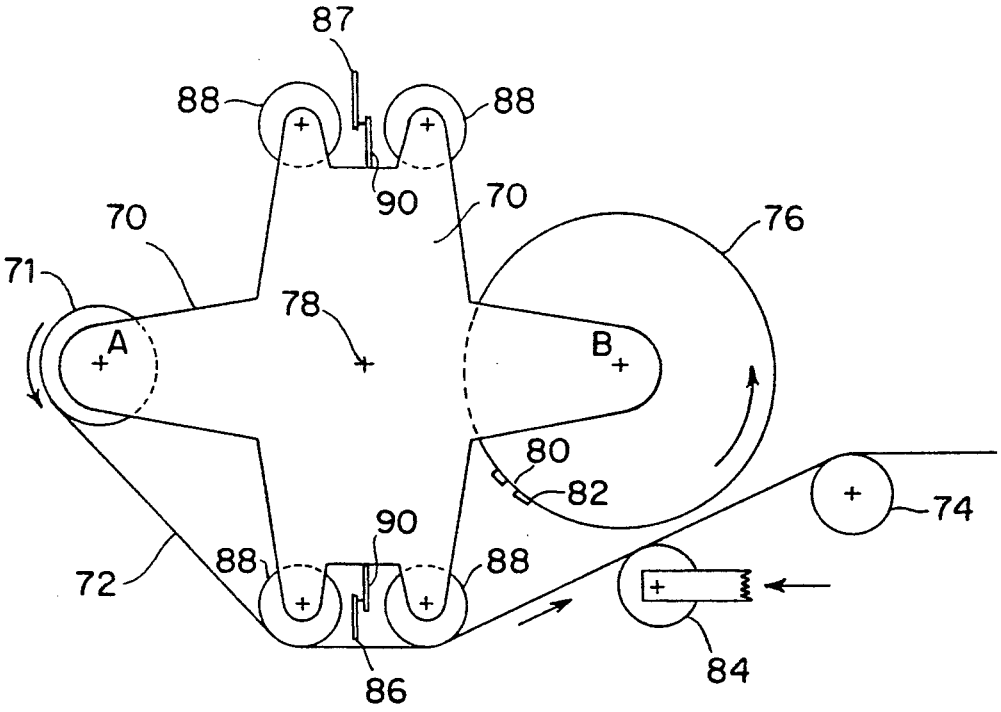
FIG. 10 CONVENTIONAL ART
Figure 11:
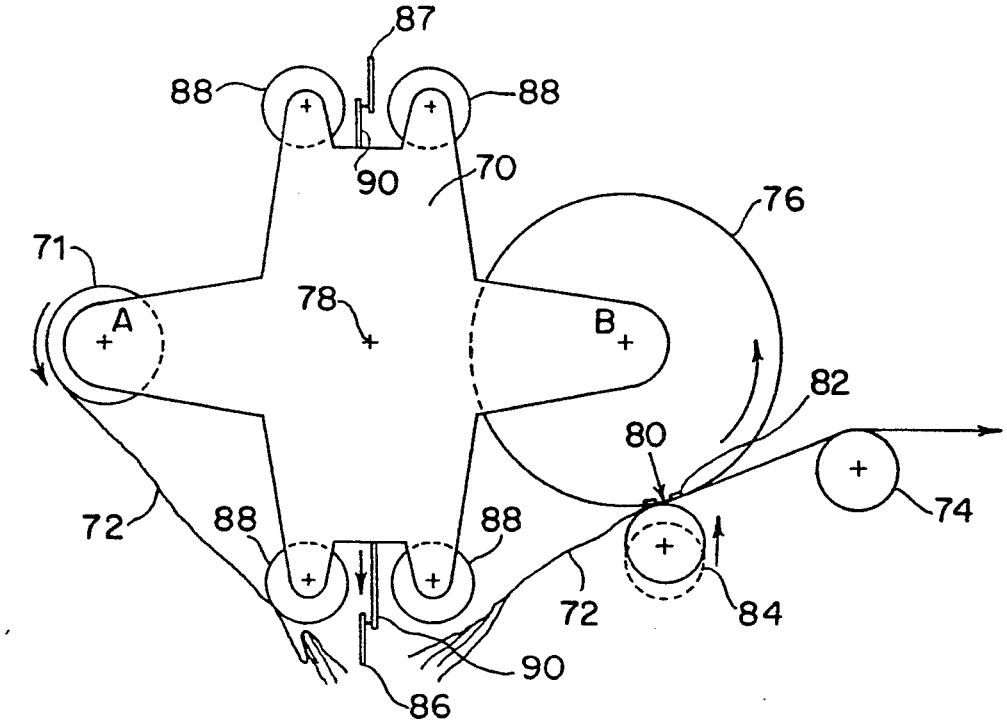
FIG. 11 CONVENTIONAL ART
Figure 12:
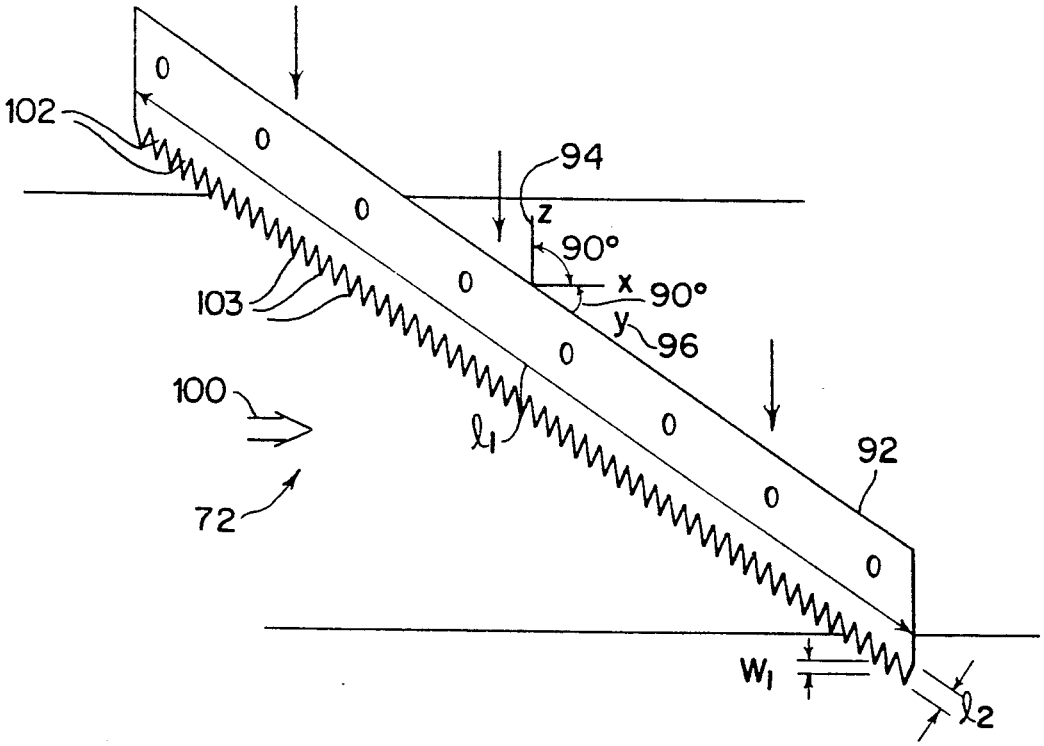
FIG. 12 CONVENTIONAL ART
Figure 13:
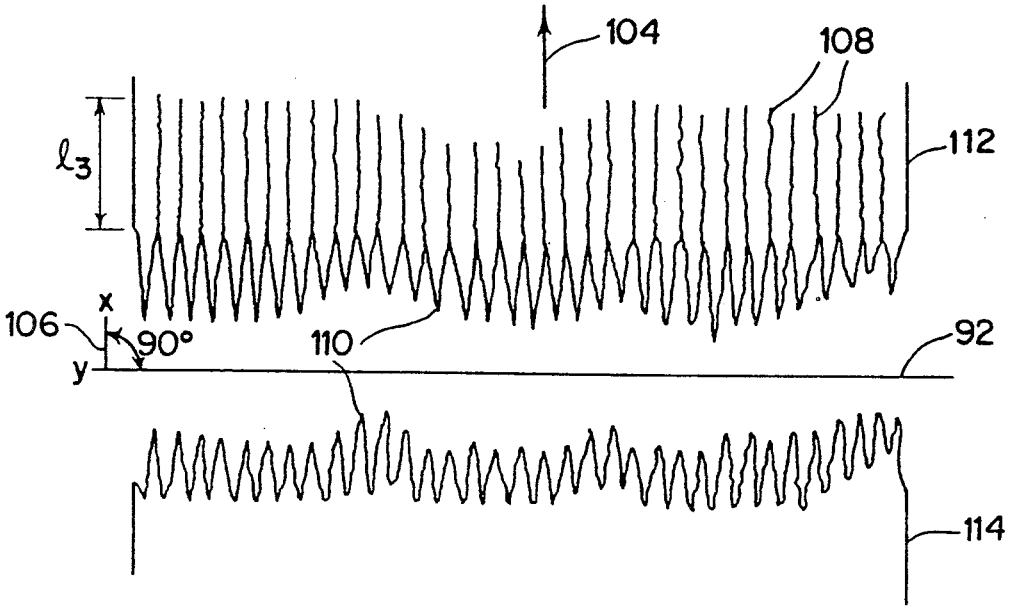
FIG. 13 CONVENTIONAL ART
Figure 14:
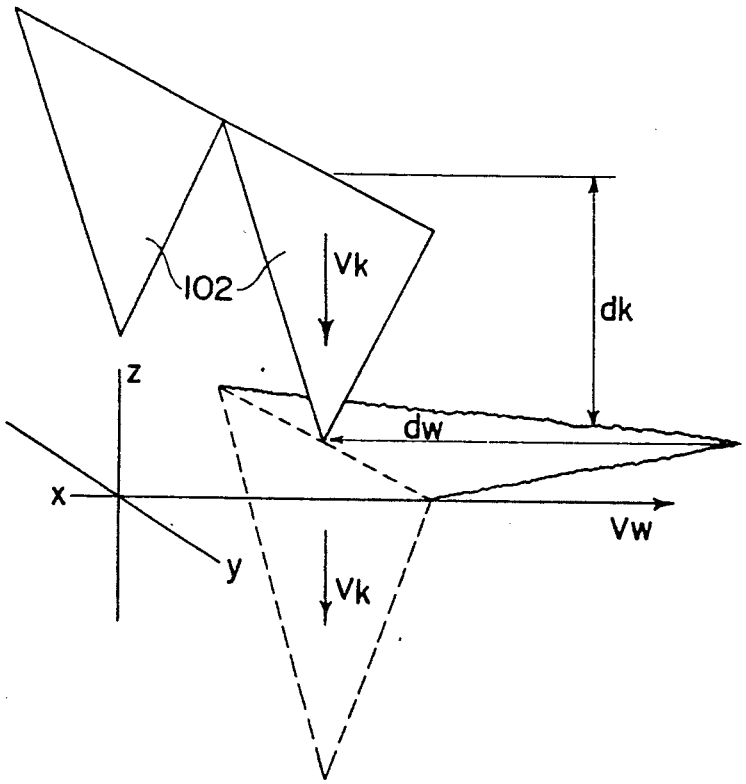
FIG. 14 CONVENTIONAL ART
Figure 15:
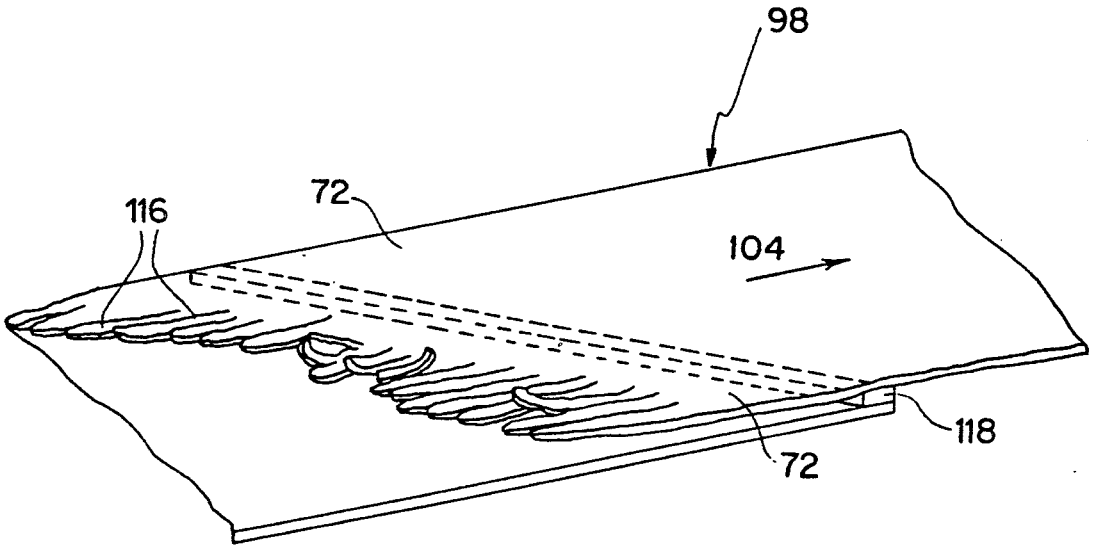
FIG. 15 CONVENTIONAL ART

FIG, 5A is a top view of blade orientations for a knife assembly according to a third preferred embodiment of the present invention;

FIG. 5B is a side view of FIG. 5A;

FIG. 6 is a side view of a turrent showing the orientation of an expiring web to a new roll of material according to the present invention;

FIG. 7 is a side view of the turrent rotated 180° during a web severing sequence;

FIG. 8 is a perspective view of a straight cut or tear resulting from severing of a web according to the present invention;

FIG. 9 is a side view of a turrent having an expiring roll and a new roll mounted thereon according to a conventional severing arrangement;

FIG. 10 is a side view of the turrent shown in FIG. 9 rotated 180° prior to a severing operation;

FIG. 11 is a side view of a turrent during a severing operation subsequent to FIG. 10;

FIG. 12 is a perspective view of a conventional knife assembly for use in conventional web severing devices;

FIG. 13 is a top plan view of a conventional knife orientation and resulting web tears from use of the conventional knife;

FIG. 14 is a detailed view of a conventional knife tooth and its relationship to a web being severed; and FIG. 15 is an underside view of a conventional knife tear resulting from use of a conventional knife assembly.

DETAILED DESCRIPTION OF PREFERRED EMBODIMENTS

The need to create a relatively straight cut or tear on a severed web is necessary to improve operations of a coating machine. A straight tear or cut edge 120, as particularly shown in FIG. 8 will accumulate comparatively small amounts of coating near the tail of a splice 118 and will have no large fragments that could cause clogging of coater parts as described in connection with the Conventional Art.

The knife designed to yield this straight cut is unique because of the ability to sever a moving unsupported web 98 resulting in a straight edge 120 on the moving web, without a jagged or fragmented tear edge characteristic of conventional two-dimensional flying splice cut-off knives.

Figure 1:
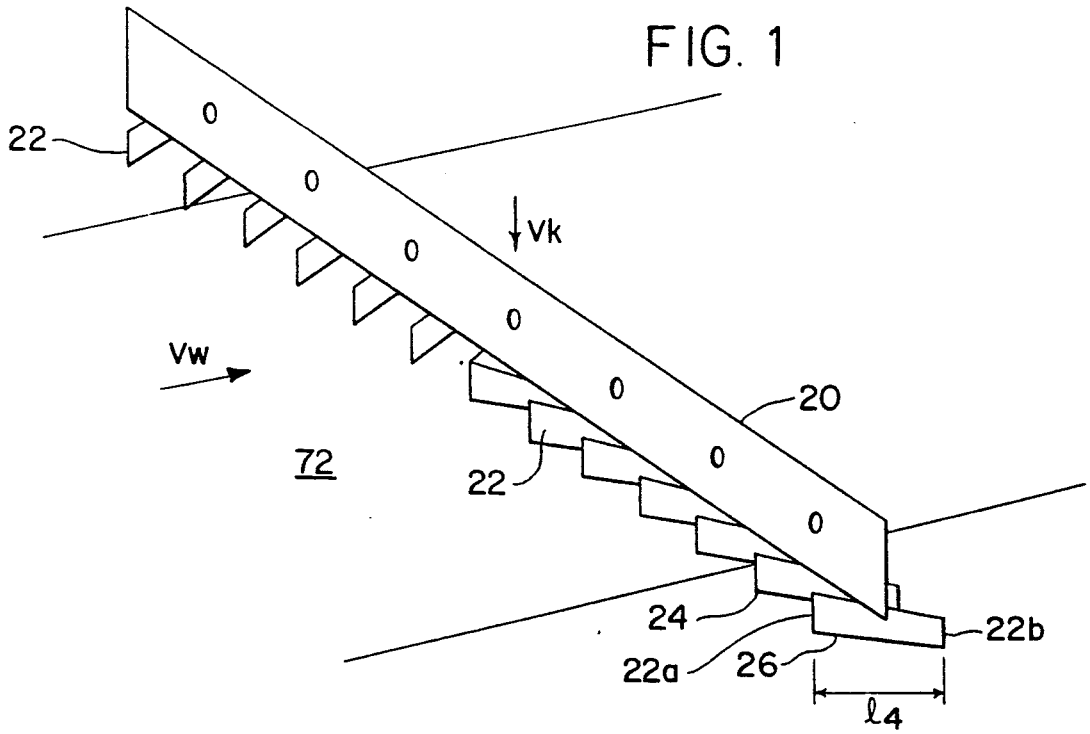
FIG. 1 is a perspective view of a knife assembly for use in the present invention.
Figure 2:
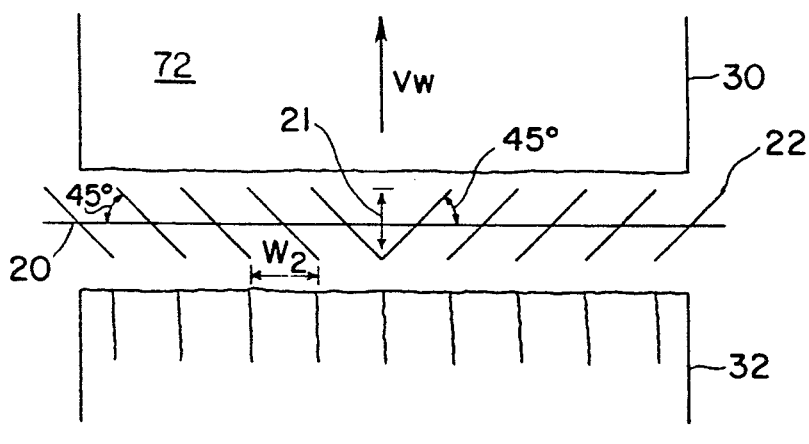
FIG. 2 is a top schematic view of the knife assembly in connection with a moving web of material particularly showing an orientation of knife blades.
Figure 3:
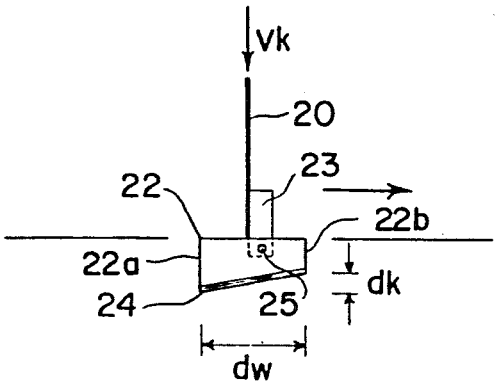
FIG. 3 is a side view of the arrangement shown in FIG. 2.

A preferred knife assembly is shown in FIGS. 1 through 3 and includes two distinct orientations of a plurality of parallel knife blades 22 individually mounted to a block 23 or the like of a support frame 20 by means of bolts, screws, or similar fasteners shown generally as 25. The block 23 is preferably integrally formed with the support frame 20 and depends therefrom so in that the blades 22 are mounted beneath the frame. Each blade section 22 is sharpened with a beveled cut along the lower edge of the blade 26 and is longer at a forward edge **22*a* of the blade than a rearward edge 22*b* of the blade 26. FIG. 2 is a top schematic view of the knife assembly shown in FIG. 1 with the spliced web portions 30 and unspliced web portions 32 being shown. FIG. 3 is a side view of FIG. 1 showing further details of an individual knife blade 22 particularly attached to the support frame 20**.

Because of the knife shape and orientation, comparatively large knife teeth can be used which results in little or no web deflection without supporting the web against an anvil during severing of the web. This makes the installation of the knife a relatively low cost modification to an existing unwind turrent 70.

Referring again to FIG. there is shown a preferred orientation of knife blade 22. This arrangement allows each blade section to initiate a cut with a lead point 24 thereof no matter where a longitudinal edge of the web is positioned, thereby enabling the knife to be capable of creating a straight cut for any width web.

In FIG. 2, the web direction is shown as Vw, the web is shown at 30, and it can be seen that two sections of individual knife blades 22 are provided in which one section has a forward end of the blades oriented at 45° with respect to the center 21 of the knife frame 20 and angled to the left from a center portion 21 of the knife frame 20 whereas a second section of knife blades have forward ends thereof angled at 45° to the right from the center line 21 of the knife frame 20.

The preferred dimensions of an individual blade 22 are as follows.

An individual knife blade length $l_4$ in the preferred design is $2\frac{3}{4}$ inches (6.985 cm). Each blade is set at a 45° angle from the machine direction axis 21 along the knife frame 20 and towards the center 21 of the frame. The cosine of the blade angle (45°) multiplied by the blade length is equal to dw. The sine of the blade angle (45°) multiplied by the blade length $l_4$ is equal to the width of the web cut per blade. A 100 inch (254 cm) wide knife will require fifty $2\frac{3}{4}$ inch (6.985 cm) long blades set at a 45° angle and at a distance 2 inches (5.08 cm) apart as shown as $w_2$.

Special constraints in weight limits on the firing system limit the size of the knife blades. The larger the knife blades, the fewer the number of knife-to-web contact points and the smaller the web deflection. The size of the knife blades in the preferred design shows minimal amounts of web deflection when the cutting action is viewed with a high speed video. Each knife section 22 is manufactured individually out of steel and is mounted to the knife frame with hardened steel fasteners or the like.

Figure 4:
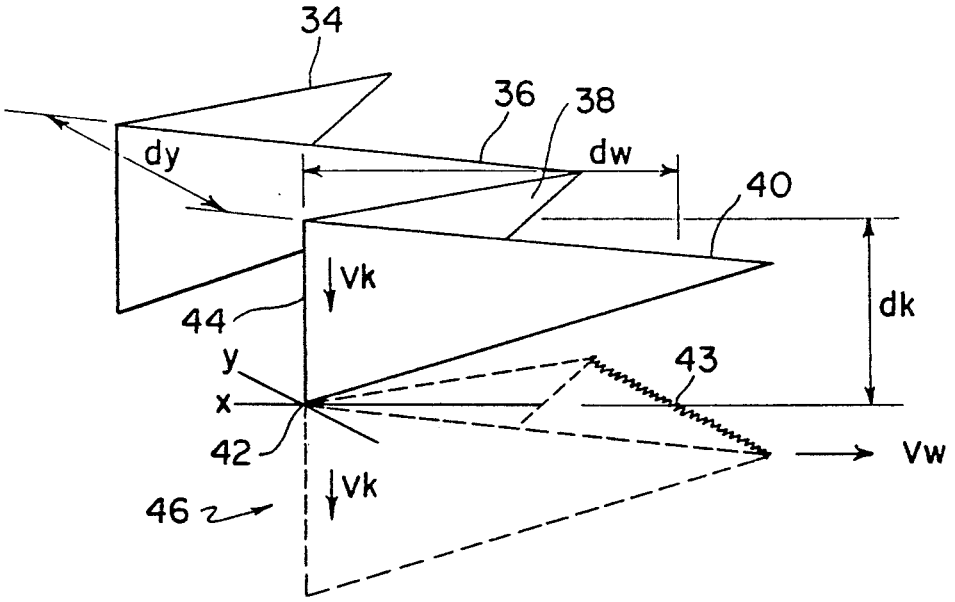
FIG. 4 is a side perspective view of a blade arrangement for the knife assembly according to a second preferred embodiment of the present invention.

FIG. 4 shows a detailed view of four blade sections 34, 36, 38 and 40 from a straight cutting unwind knife. Element dy is a distance between forward edges 44 of adjacent blades. To make a straight cut, a time tw required for the web 30 to travel from a point 42 where the cut is initiated to a position 43 where the cut is completed must be equal to the time tk required for the knife blade to travel from a position 44 above a planar surface of web 30 to position 46 below a planar surface of web 30. Therefore, $$tk = tw \tag{3}$$

in order to make a straight cut.

The time, tw, can be expressed in terms of web velocity Vw along the x axis and knife blade machine direction distance dw as:

$$tw = dw/Vw \tag{4}$$

The time, tk, can be expressed in terms of knife velocity Vk along the z-axis and knife blade height dk as:

$$tk = dk/Vk \tag{5}$$

The condition for a straight cut can be defined as:

$$dk/Vk = dw/Vw \tag{6}$$

The knife blade sections 34, 36, 38 and 40 in FIG. 4 can be positioned in different configurations to meet the condition expressed in Equation 6. It should also be understood that Equation 6 holds true for the knife blade sections shown in FIGS. 1 through 3.

FIG. 5A is a top view of a bidirectional unwind flying splice knife according to a third preferred embodiment of the present invention. A plurality of individual blades 48, 50, 52, and 54 are arranged at predetermined positions and at 45° with respect to the support frame 20. The embodiment of FIG. 5A and 5B differs from that of FIGS. 1 through 3 only in the positioning of knife blades at forward and rearward sides of the frame 20. This preferred design enables making straight cuts for webs moving in either forward or reverse directions.

FIG. 5B is a side view showing the orientation of the knife blades 54 and 50 as well as their relative dimensions according to the equations described above.

FIG. 6 generally shows the inventive knife blade assemblies of any of the above embodiments as 56, mounted to either a pneumatic or hydraulic firing means 90 similar to that described above. Turrent 70 is in a position where an expiring web roll 71 has an expiring web portion 72 thereon passing over an idler roller 74. Operation of the turrent shown in FIGS. 6 and 7 is as follows. Referring first to FIG. 6, an expiring wound roll 71 of web material 72 is shown being unwound by rotation on a spindle A past an idler roller 74 leading to a processing machine (not shown). As the material or web 72 from expiring roll 71 is exhausted, a turrent 70 interchanges a new roll 76 rotating on a spindle B with the expiring roll 71 by rotating the turrent 70 around a turrent axis 78 in a clockwise direction. Before the new roll 76 is interchanged with the expiring roll 71, two-sided adhesive tape 80 is placed along the leading edge 82 of an unspliced web on the new roll 76. A rubber paster roller 84 is used to compress the two webs together and is shown positioned in a retracted state in FIG. 6 to allow the turrent 70 to rotate.

FIG. 7 shows a severing operation with the turrent rotated 180° in order to position the expiring web 72 under flying splice knife 56A. Each of two flying splice knives 56A, 56B, are an opposite side of turrent 70 and positioned between two rotatable support rollers 88. The knife 56A is shown in a "ready to fire" position in FIG. 6 and a released position in FIG. 7. After the turrent 70 is repositioned through the above-mentioned 180° rotation, the new roll 76 is accelerated to rotate at the same outer surface speed as the web 72 while the paster roller 84 is moved to a "ready to fire" position. When the expiring roll 71 reaches a minimum diameter, the severing and splicing sequence is triggered, thereby firing the paster roller 84 against the new roll 76 which sticks the expiring web 72 to the new roll 76 as the two-sided adhesive 80 passes through a nip formed by the paster roll 84 pressed against the new roll 76. Almost simultaneously, the flying splice knife 56A is fired downward into the expiring web 72 as shown in FIG. 6 by a high speed pneumatic or hydraulically actuated firing mechanism 60 at an orientation perpendicular to a longitudinal axis of the web 72. The web 72 is cut by the knife in a crosswise direction. After an expired core located at the center of the expired roll 71 is removed and replaced with a fresh wound roll on spindle A, the severing and splicing cycle is ready to be repeated, this time using the remaining flying splice knife 56B after another 180° rotation of the turrent 70. Although only knife 56A is shown in detail, it should be understood that knife 56B is identical and both knives 56A, 56B are of the inventive type described above.

As shown in FIG. 8, a straight cut or tear in web 72 results as shown at 120 by severing the web with the inventive knife assembly described above. The smooth edge 120 is free of ribbons or the like which could be caught in machine parts and therefore provides a reliable splice at 118.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A web severing device for a moving web, comprising:

a support member positioned substantially orthogonal to a longitudinal direction of said web, a centerline of said support member corresponding to a longitudinal center line of said moving web;

a first plurality of blade sections provided on said support member, each of said first plurality of blade sections including at least a forward web-engaging portion;

a second plurality of blade sections provided on said support member, each of said second plurality of blade sections including at least a forward web-engaging portion;

means for mounting said first and second plurality of blade sections to said support member such that the forward web-engaging portions are at a predetermined acute angle with respect to the centerline of said support member; and means for simultaneously engaging said first and second plurality of blade sections with said moving web, the predetermined angles of said first and second plurality of blade sections enabling a cutting action from the center to the outer edges of said moving web thereby providing a smooth severed web edge which extends in a straight line between the outer edges.

2. The web severing device according to claim 1, wherein said predetermined angle for each of said first and second plurality of blade sections is substantially 45° with respect to the centerline of said support member and thereby also at substantially 45° with respect to a longitudinal direction of the web.

3. The web severing device according to claim 1, wherein each of said plurality of blade sections includes a beveled cutting edge gradually recessed in depth from the forward web-engaging portion to a trailing end portion thereof such that the forward portion pierces the web prior to the trailing end portion thereof.

4. The web severing device according to claim 1, wherein each of said first and second plurality of blade sections are independently mounted by said means for mounting to said support member and independently adjustable according to cutting requirements for the moving web.

5. The web severing device according to claim 1, wherein said means for mounting includes a plurality of blocks independently mounted on the support member and a plurality of corresponding fastener means for attaching a single one of said first and second plurality of blade sections to each of said plurality of blocks.

6. A web severing device for a moving web, comprising:

a support member positioned substantially orthogonal to a longitudinal direction of and facing said web, a centerline of said support member corresponding to a longitudinal center line of said moving web;

a first plurality of blade sections individually mounted at a predetermined acute angle to said support member;

a second plurality of blade sections individually mounted at a predetermined acute angle to said support member and opposite an orientation of said first plurality of blade sections; and means for simultaneously engaging said first and second plurality of blade sections with the moving web free of an anvil or backing on an opposing face of the moving web from said support member, said means for engaging enabling said first and second plurality of blade sections to cut said moving web, thereby providing a smooth severed web edge which extends in a straight line from one longitudinal edge of the web to the other longitudinal edge of the web.

7. The web severing device according to claim 6, wherein each of said first and second plurality of blade sections includes at least a forward web-engaging portion and said device further includes means for mounting said first and second plurality of blade sections to said support member such that the forward web-engaging portions are at an acute angle with respect to the centerline of said support member.

8. The web severing device according to claim 7, wherein the predetermined acute angles of said first and second plurality of blade sections enables a cutting action from the center line to an outer edge of said moving web, thereby providing said smooth severed web edge.

9. The web severing device according to claim 7, wherein said means for mounting includes a plurality of blocks independently mounted on the support member and a plurality of corresponding fastener means for attaching a single one of said first and second plurality of blade sections to each of said plurality of blocks.

10. The web severing device according to claim 7, wherein said predetermined angle for each of said first and second plurality of blade sections is substantially 45° with respect to the centerline of said support member and thereby also at substantially 45° with respect to a longitudinal direction of the web.

11. The web severing device according to claim 7, wherein each of said plurality of blade sections includes a beveled cutting edge gradually recessed in depth from the forward web-engaging portion to a trailing end portion thereof such that the forward portion pierces the web prior to the trailing end portion thereof.

12. The web severing device according to claim 7, wherein each of said first and second plurality of blade sections are independently mounted by said means for mounting to said support member and independently adjustable according to cutting requirements for the moving web.

* * * * *